US005526629A

United States Patent [19]

Cavaness

[11] Patent Number: 5,526,629

[45] Date of Patent: Jun. 18, 1996

[54] COMPOSITE BUILDING PANEL

[75] Inventor: Joseph A. Cavaness, Riverdale, Ga.

[73] Assignee: Cavaness Investment Corporation, Riverdale, Ga.

[21] Appl. No.: 74,218

[22] Filed: Jun. 9, 1993

[51] Int. Cl.[6] ..... E09B 1/00

[52] U.S. Cl. ..... 52/745.19; 52/792.14; 52/602; 52/356; 52/630; 264/263

[58] Field of Search ..... 52/600, 601, 220.2, 52/270, 602, 356, 630, 649.1, 742.13, 742.14, 745.19; 264/279, 275, 263, 264, 259, 279

[56] References Cited

U.S. PATENT DOCUMENTS

| | | | |
|---|---|---|---|
| 917,478 | 4/1909 | Noble . | |
| 1,475,847 | 11/1923 | Marks | 52/600 |
| 1,936,147 | 11/1933 | Young | 72/73 |
| 2,083,055 | 6/1937 | Coddington | 52/601 |
| 2,092,752 | 9/1937 | Davis | 52/602 |
| 2,145,407 | 1/1939 | Soule | 72/115 |
| 2,369,595 | 2/1945 | Miles et al. | 52/483 |
| 3,245,185 | 4/1966 | Rowe | 52 X/220.2 |
| 3,284,979 | 11/1966 | Edwards | 52/600 |
| 3,363,371 | 1/1968 | Villalobos | 52/90 |
| 3,401,497 | 9/1968 | Gregory et al. | 52/677 |
| 3,466,825 | 9/1969 | Guddal | 52/828 |
| 3,533,205 | 10/1970 | Pestel et al. | 52/356 |
| 3,802,147 | 4/1974 | O'Konski | 52/630 |
| 3,885,008 | 5/1975 | Martin | 52/828 |
| 4,185,437 | 1/1980 | Robinson | 52/601 |
| 4,387,544 | 6/1983 | Schigler et al. | 52/405 |
| 4,566,240 | 1/1986 | Schilger | 52/414 |
| 4,602,467 | 7/1986 | Schilger | 52/319 |
| 4,619,032 | 10/1986 | Sudrabin | 52 X/601 |
| 4,633,634 | 1/1987 | Nemmer | 52 X/601 |
| 4,649,682 | 3/1987 | Barrett | 52 X/601 |
| 4,653,237 | 3/1987 | Taft | 52/335 |
| 4,909,007 | 3/1990 | Bodnar | 52/602 X |
| 4,930,278 | 6/1990 | Staresina | 52 X/600 |

FOREIGN PATENT DOCUMENTS

| | | | |
|---|---|---|---|
| 922864 | 3/1973 | Canada | 20/24 |
| 1134162 | 10/1982 | Canada | 72/47 |
| 1178819 | 12/1984 | Canada | 72/42 |
| 1172463 | 8/1989 | Canada | 20/47 |
| 84618 | 7/1921 | Germany . | |

OTHER PUBLICATIONS

D-House by Design Concrete, Inc.; "Our Concrete looks like Wood". —Sales Brochure—.

*Primary Examiner*—Carl D. Friedman
*Assistant Examiner*—Beth A. Aubrey
*Attorney, Agent, or Firm*—Louis T. Isaf; James A. Witherspoon

[57] ABSTRACT

Provided is a composite building panel including, in accordance with a preferred embodiment, a planar concrete slab portion at the front and a plurality of elongated frame members at the rear. Each frame member includes a first end and an opposite second end that define a length therebetween, and a front side and a rear side which define a width therebetween which is less than the length. The front side of each frame member is imbedded in the concrete slab portion along the entire length of the frame member, and the rear side of each frame member is oriented opposite from the concrete slab portion. The frame members are, in accordance with preferred embodiments, all oriented on one side of the concrete slab portion and function to reinforce the concrete slab portion; to define cavities therebetween for the installation of plumbing, electrical wiring, and insulation; and to provide for the attachment of wallboard. Composite building panels are formed, for example, by attaching the frame members to one another to form a frame assembly which is suspended horizontally above a pouring pad by forms that bound the frame assembly. Uncured concrete is poured between the forms to a depth such that, along the lengths of the frame members, the first sides of the frame members are imbedded in the concrete and the second sides extend from the concrete. Composite panel systems include, for example, variously shaped composite building panels that are attached together to form, for example, a building.

17 Claims, 3 Drawing Sheets

COMPOSITE BUILDING PANEL

BACKGROUND OF THE INVENTION

The present invention relates generally to the field of buildings, and, in its most preferred embodiments, to prefabricated building panels used in the construction of buildings.

Prefabricated building panels, hereafter referred to simply as building panels, have been known of and used for quite some time. Building panels are typically constructed at one location and transported to another location where they are attached to one another to fabricate a building. Building panels are constructed in a variety of configurations and from a variety of materials. Wood and concrete are examples of materials from which building panels are constructed. Concrete building panels are often preferred over wooden panels for a variety of reasons. For example, wood is much more susceptible to termites and rotting than is concrete, trees are presently considered to be a more threatened natural resource than are the products from which concrete is fabricated, and concrete has a much longer potential life-span than does wood.

While concrete building panels have some advantages, typical concrete building panels can have some disadvantages. For example, while concrete has a high compression strength, it has a relatively low tensile strength. Therefore, it is often necessary to imbed reinforcement members in concrete building panels in order to improve their tensile strength. Also, conventional concrete building panels are typically simple concrete slabs that are planar on both sides. In many building situations, such a concrete slab is not suitable alone for use as a completed wall. For example, such a concrete slab alone cannot function suitably as a wall because it would not provide "wall cavities" for the conventional placement of other components used in the fabrication of buildings. For example, it is often necessary to suitably install insulation, plumbing, and electrical wiring within "wall cavities" that are accessible from within a building structure, and then to apply, for example, wallboard over the "wall cavities". Therefore, conventional concrete building panels are usually used as veneer-like structures behind which a substructure must be employed.

There is, therefore, a need in the industry for a method and an apparatus which address these and other related, and unrelated, problems.

SUMMARY OF THE INVENTION

Briefly described, the present invention includes, in its most preferred embodiment, a new composite building panel and a method of making the new composite building panel. The composite building panel preferably includes multifunction frame members having an elongated side imbedded into a concrete portion, and an elongated side extending from the concrete portion.

In one preferred embodiment, the composite building panel includes a front and a rear, and a planar concrete slab portion at the front and a plurality of multifunction frame members at the rear. The frame members include a first end and an opposite second end that define a length therebetween. The frame members also include a front side and a rear side which define a width therebetween. The width is less than the length. The front side of each frame member is imbedded in the concrete slab portion along the entire length of the frame member, and the rear side of each frame member is oriented opposite from the concrete slab portion.

The frame members function to reinforce the concrete slab portion due to the fact that they are partially imbedded therein. Also, the frame members define cavities therebetween. The cavities function to provide for the installation of plumbing, electrical wiring, and insulation therein. The frame members also provide for the attachment of wallboard thereto such that the cavities are covered.

Composite building panels of various shapes and sizes, and including, for example, window and door openings, are within the scope of the present invention. Composite panel systems include composite building panels that are attached together to form, for example, a building. The composite building panels are attached by attaching a frame member at the edge of one composite building panel to a frame member at the edge of another composite building panel.

Composite building panels are formed, for example, by first appropriately attaching frame members to one another to form a frame assembly. The frame assembly is suspended horizontally above a pouring pad by forms that bound the frame assembly. Uncured concrete is poured between the forms to a depth such that the front sides of the frame members are imbedded in the concrete and the rear sides of the frame members extend from one side of the concrete. Once the concrete cures, the forms are removed from the newly formed composite building panel which is ready to be transported and used as part of a composite panel system.

In accordance with preferred embodiments of the present invention, the frame members are structural steel studs. Thus, the concrete slab portion of the composite building panel is greatly reinforced by those portions of the frame members that are imbedded in the concrete slab portion. Also, the composite building panels are not susceptible to the problems that are inherent to structures fabricated from wood.

It is therefore an object of the present invention to provide a new building panel, and a method of making the new building panel.

Another object of the present invention is to provide a building panel that includes frame members having an elongated side imbedded into a concrete portion, and an elongated side extending from the concrete portion.

Yet another object of the present invention is to provide a building panel that is substantially termite-proof.

Still another object of the present invention is to provide a building panel that is substantially fireproof.

Still another object of the present invention is to provide a building panel that is not subject to rotting.

Still another object of the present invention is to provide a building panel having a maintenance-free concrete exterior.

Still another object of the present invention is to provide a building panel that can, while unprotected and exposed during the construction phases of a building project, withstand extended exposure to adverse weather conditions.

Still another object of the present invention is to provide a concrete-type building panel that is substantially ready for use once the concrete from which it is partially fabricated is cured.

Still another object of the present invention is to provide a building panel having a longer life-span than conventional building panels.

Still another object of the present invention is to provide a building panel that is stronger than conventional building panels.

Still another object of the present invention is to provide a building panel that is not subject to warping or deformation.

Still another object of the present invention is to provide a building panel that combines, in a unitary component, the benefits and functionality of an exterior structure and an interior substructure.

Still another object of the present invention is to provide a building panel that includes cavities for the easy installation of plumbing, electrical wiring, and insulation.

Still another object of the present invention is to provide building panels that function together as a panel system.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
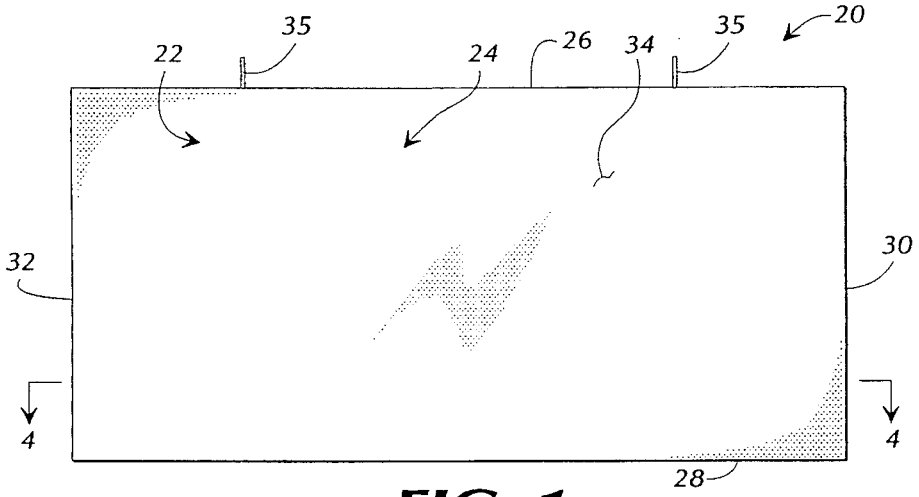
FIG. 1 is a front view of a composite building panel in accordance with the first preferred embodiment of the present invention.

Referring now in greater detail to the drawings, in which like numerals represent like components throughout the several views, FIG. 1 is a front view of a composite building panel 20 in accordance with the first preferred embodiment of the present invention. The composite building panel 20 includes a concrete slab portion 22, a front 24, a top edge 26, a bottom edge 28, a first side edge 30, and a second side edge 32, and defines a front surface 34. The front surface 34 is defined by the concrete slab portion 22 and extends between the top edge 26, bottom edge 28, first side edge 30 and second side edge 32. The concrete slab portion 22 also defines the top edge 26, bottom edge 28, first side edge 30, and second side edge 32 at the front 24 of the composite building panel 20. The composite building panel 20 also includes lifting loops 35 that extend from the top edge 26 of the composite building panel 20.

Figure 2:
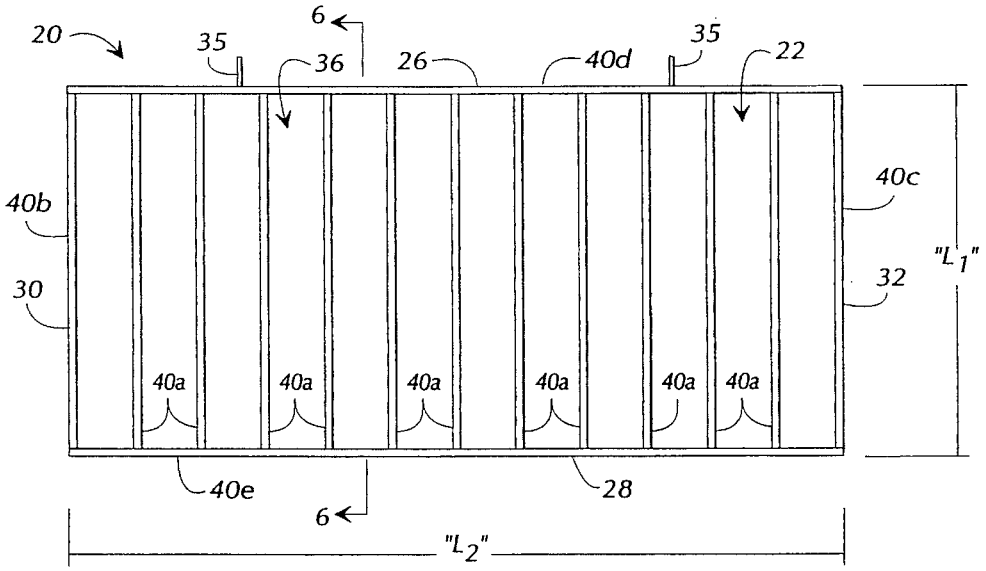
FIG. 2 is a rear view of the composite building panel of FIG. 1.

FIG. 2 is a rear view of the composite building panel 20 of FIG. 1. As shown in FIG. 2, the composite building panel 20 further includes a rear 36, and plurality of multifunction frame members 40 are exposed and extend from the concrete slab portion 22 at the rear 36. In accordance with the first preferred embodiment of the present invention, a majority of the multifunction frame members 40 are vertically oriented frame members **40*a* (a cross members) having portions of the concrete slab portion 22 on either side thereof. One of the frame members 40 is frame member 40*b* (a boundary member) which is adjacent to the first side edge 30 of the composite building panel 20. Frame member 40*b* defines the first side edge 30 at the rear 36 of the composite building panel 20. Another of the frame members 40 is frame member 40*c* (another boundary member) which is adjacent to the second side edge 32. Frame member 40*c* defines the second side edge 32 at the rear 36 of the composite building panel 20. Still another of the frame members 40 is frame member 40*d* (yet another boundary member) which is adjacent to and actually defines the top edge 26 at the rear 36 of the composite building panel 20. Still another of the frame members 40 is frame member 40*e* (still another boundary member) which is adjacent to and actually defines the bottom edge 28 at the rear 36 of the composite building panel 20. In accordance with the first preferred embodiment of the present invention, frame members 40*a,b,c* extend between and are welded to frame members 40*d,e* at the top edge 26 and bottom edge 28, respectively, of the composite building panel 20. Frame members 40*a,b,c* define a length "$l_1$", which is discussed in greater detail below. Frame members 40*d,e*** define a length "$l_2$", which is also discussed in greater detail below.

Figure 3:
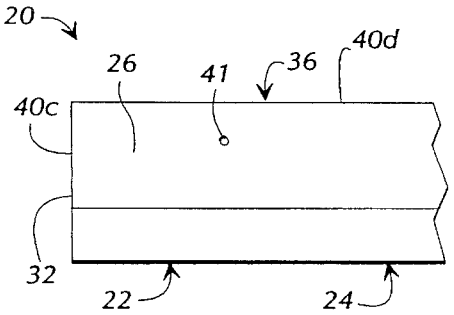
FIG. 3 is a cut-away view of the top edge of the composite building panel of FIG. 1.

FIG. 3 is a cut-away view of the top edge 26 of the composite building panel 20 of FIG. 1. Portions of the composite building panel 20 toward the first side edge 30 (FIGS. 1 and 2) are cut-away In FIG. 3. As shown, the concrete slab portion 22 is oriented toward the front 24 whereas frame member **40*d* (and thus frame members 40*a,b,c,e* (FIG. 2)) is oriented toward the rear 36 of the composite building panel 20. Frame member 40*d* defines attachment holes 41 (only one of which is shown) therethrough. Attachment holes 41 are discussed in greater detail below. In accordance with the first preferred embodiment of the present invention, and as shown in FIG. 3, the concrete slab portion 22 and frame member 40*c* are positioned such that they together define the planar second side edge 32. Likewise, the concrete slab portion 22 and frame member 40*b* (FIG. 2) are positioned relative to one another such that they together define the planar first side edge 30 (FIGS. 1 and 2). Although not shown, a plan view of the bottom edge 28 (FIGS. 1 and 2) of the composite building panel 20 is the mirror image of a plan view of the top edge 26**.

Figure 4:
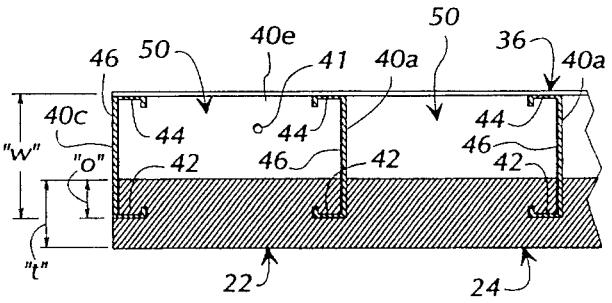
FIG. 4 is a cut-away view of the composite building panel of FIG. 1 taken along line 4—4 of FIG. 1.

FIG. 4 is a cut-away view of the composite building panel 20 taken along line 4—4 of FIG. 1. In FIG. 4, portions of the composite building panel 20 toward the first side edge 30 (FIGS. 1 and 2) are cut-away. As shown, frame members **40*a,c* extend upward from frame member 40*e* and include a front 42, a rear 44, and a side 46. The fronts 42 are embedded in the concrete slab portion 22, and the sides 46 are partially embedded in and extend from the concrete slab portion 22 such that the rears 44 are opposite from the concrete slab portion 22. Frame member 40***b* (FIG. 2) also extends upward from frame member 40*e*, and includes a front 42 embedded in the concrete slab portion 22, a side 46 extending from the concrete slab portion 22, and a rear 44 opposite from the concrete slab portion 22. The fronts 42 of frame members 40*a,b,c* are embedded in the concrete slab portion 22 along the entire length "$l_1$" (FIG. 2) of frame members 40*a,b,c*. The composite building panel 20 defines a plurality of open spaces or cavities 50 that are accessible at the rear 36 of the composite building panel 20. In accordance with the first preferred embodiment of the present invention, a cavity 50 is defined in the space between frame members 40*a,b,e*, (see also FIG. 2). Each cavity 50 is partially bounded by frame members 40*d,e* (see also FIG. 2) and the concrete slab portion 22. As shown, frame member 40*e* also defines attachment holes 41 (only one of which is shown) therethrough. In accordance with the first preferred embodiment of the present invention, reinforcing rods and wire are attached to the fronts 42 of frame members 40*a,b,c* and are therefore embedded in the concrete slab portion 22; however, the reinforcing rods and wire are not shown in FIG. 4 in an effort to clarify the view.

Figure 5:
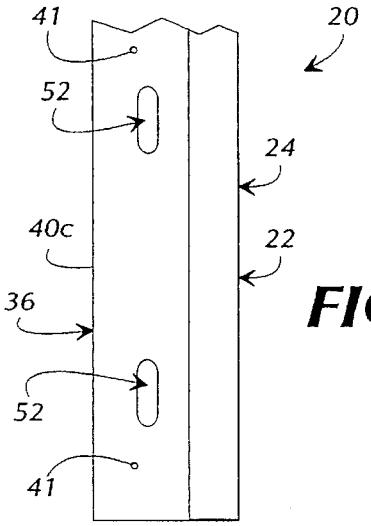
FIG. 5 is a cut-away, side view of the composite building panel of FIG. 1.

FIG. 5 is a cut-away view of the second side edge 32 of the composite building panel 20 of FIG. 1. Portions of the composite building panel 20 toward the top edge 26 (FIGS. 1–3) are cut-away in FIG. 5. As previously shown and discussed, the concrete slab portion 22 is oriented toward the front 24 whereas frame member 40*c* and frame members 40*a,b,d,e* (FIG. 2) are oriented toward the rear 36 of the composite building panel 20. Frame member 40*c*, and frame members 40*a,b* (FIG. 2), define a plurality of passages 52 therethrough. The passages 52 provide a communication path between adjacent cavities 50. Frame member 40*c* also defines attachment holes 41 (only two of which are shown) therethrough. Although not shown, an elevational view of the first side edge 30 (FIGS. 1 and 2) of the composite building panel 20 is a mirror image of an elevational view of the second side edge 32. Thus, frame member 40*b* (FIG. 2) also defines attachment holes 41 therethrough.

Figure 6:
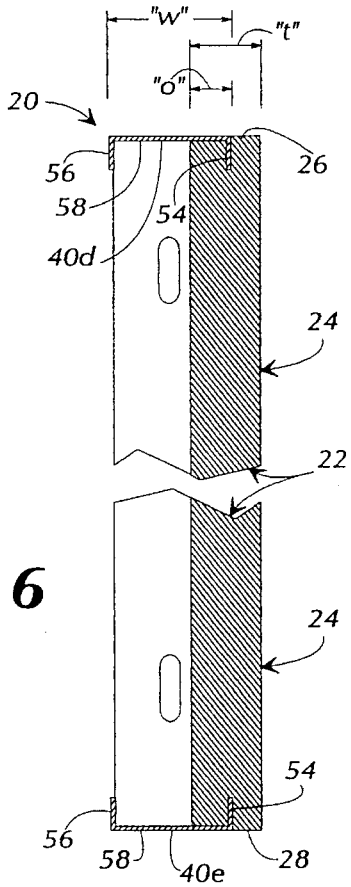
FIG. 6 is a cross-sectional, cut-away view of the composite building panel of FIG. 1 taken along line 6—6 of FIG. 2.

FIG. 6 is a cross-sectional, cut-away view of the composite building panel 20 taken along line 6—6 of FIG. 2. A portion of the composite building panel 20 between the top edge 26 and bottom edge 28 is cut-away in FIG. 6. In accordance with the first preferred embodiment of the present invention, and as shown in FIG. 6, the concrete slab portion 22 and frame member 40*d* are positioned such that they together define the planar top edge 26. Likewise, the concrete slab portion 22 and frame member 40*e* are positioned such that they together define the planar bottom edge 28. As shown, frame members 40*d,e* include a front 54, a rear 56, and a side 58. The fronts 54 are embedded in the concrete slab portion 22 along the entire length "$l_2$" (FIG. 2) of frame members 40*d,e*, and the sides 58 engage and extend from the concrete slab portion 22 such that the rears 56 are opposite from the concrete slab portion 22. As discussed above, in accordance with the first preferred embodiment of the present invention, reinforcing rods and wire are also embedded in the concrete slab portion 22; however, the reinforcing rods and wire are not shown in FIG. 6 in an effort to clarify the view.

Referring to both FIGS. 4 and 6, the fact that fronts 42,54 are imbedded in and rears 44,56 are opposite from the concrete slab portion 22 along the entire length "$l_{1,2}$" (FIG. 2) of the frame members 40 is integral to the inventive aspects of the present invention. This inventive configuration causes the frame members 40 to function as both internal reinforcement to the concrete slab portion 22 as well as elongated structures opposite from the concrete slab portion 22, as discussed below. As shown in FIGS. 4 and 6, the concrete slab portion 22 and the frame members 40 together define overlaps "$o_{1,2}$" which are the distances which the frame members 40 are imbedded in the concrete slab portion 22. Also, the concrete slab portion 22 defines a thickness "t", and the frame members 40 define widths "$w_{1,2}$" that are less than the lengths "$l_{1,2}$" (FIG. 2) defined by the frame members 40.

Figure 7:
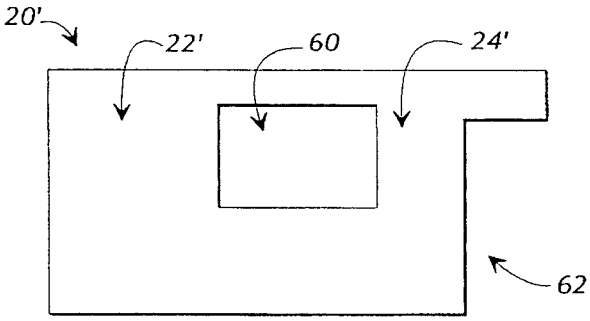
FIG. 7 is a front view of a composite building panel in accordance with a second preferred embodiment of the present invention.
Figure 8:
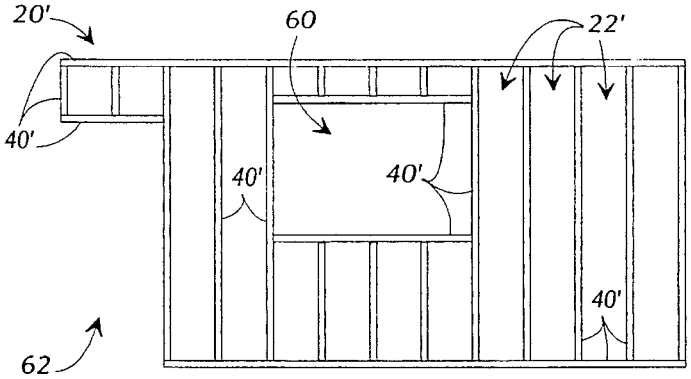
FIG. 8 is a rear view of the composite building panel of FIG. 7.

FIG. 7 is a front view of a composite building panel 20', in accordance with a second preferred embodiment of the present invention. The composite building panel 20' differs from the composite building panel 20 (FIGS. 1–6) of the first preferred embodiment in that it defines a window opening 60 and a door opening 62 therethrough. Referring to FIG. 8, which is a rear view of the composite building panel 20' of FIG. 7, the composite building panel 20' includes a plurality of frame members 40'. Some of the frame members 40' are identical to the frame members 40 of the first preferred embodiment, whereas other frame members 40' have been modified or added to the composite building panel 20' so as to define, in part, the window opening 60 and door opening 62. Only a representative view of the frame members 40' are specifically pointed out in FIG. 8 in an effort to simplify the view. Each of the frame members 40' includes an elongated portion that is imbedded in and an elongated portion that extends from the concrete slab portion 22', in the same manner in which the frame members 40 of the composite panel 20 are partially embedded in and partially extend from the concrete slab portion 22 (see FIGS. 4 and 6). Other embodiments of the present invention include variously sized and shaped composite building panels (not shown) that include various combinations of variously shaped and oriented openings.

Figure 9:
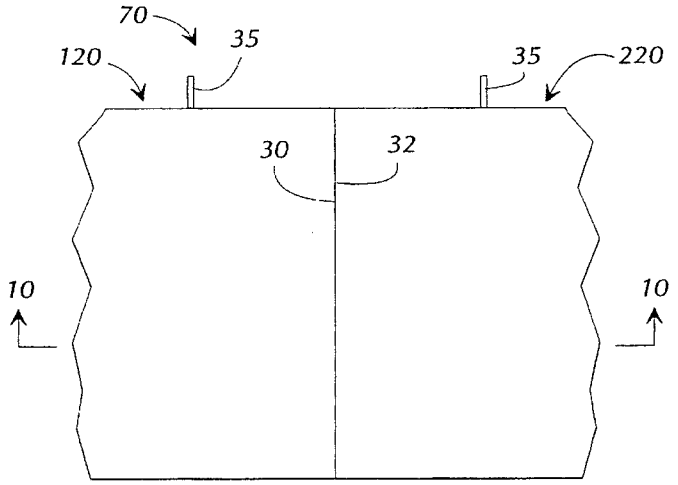
FIG. 9 is a front, cut-away view of a pair of composite building panels fastened together to form a composite panel system, in accordance with a preferred embodiment of the present invention.

FIG. 9 is a front, cut-away view of a composite panel system 70, in accordance with a preferred embodiment of the present invention. The composite panel system 70 includes a first composite building panel 120 and a second composite building panel 220, each of which are identical to the composite building panel 20 of FIGS. 1–6. The first side edge 30 of the first composite building panel 120 is attached to the second side edge 32 of the second composite building panel 220. In accordance with a preferred embodiment of the present invention, the composite building panels 120,220 are properly positioned adjacent to one another by hoisting the composite building panels 120,220 and moving them accordingly. The lifting loops 35 function to allow for the hoisting.

Figure 10:
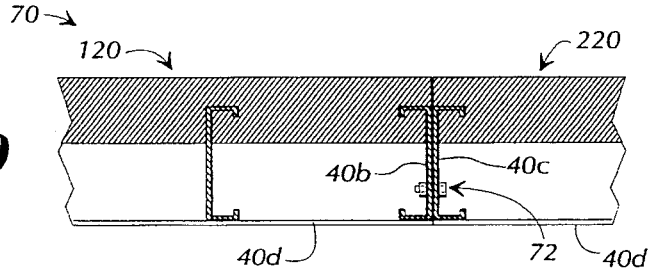
FIG. 10 is a cross-sectional view of the composite panel system taken along line 10—10 of FIG. 9.

FIG. 10 is a cross-sectional view of the composite panel system 70 taken along line 10—10 of FIG. 9. The composite building panels 120,220 are preferably secured by a plurality of bolt assemblies 72 that pass through attachment holes 41 (FIGS. 3–5). As shown in FIG. 10, a representative bolt assembly 72 passing through an attachment hole 41 (not seen) attaches frame member 40*b* of the first composite building panel 120 to frame member 40*c* of the second composite building panel 220, whereby the composite building panels 120,220 are attached. Bolt assemblies 72 and attachment holes 41 cooperate to function as attachment means. Bolt assemblies 72 are also selectively employed through attachment holes 41 in frame members 40*e* (FIG. 4), for example, to attach composite building panels 20 to a concrete slab (not shown), other flooring structures (not shown), or a frame member 40*d*. Similarly, bolt assemblies 72 are also selectively employed through attachment holes 41 in frame member 40*d* (FIG. 3), for example, to attach composite building panels 20 to roof structures (not shown), flooring structures (not shown), or a frame member 40*e*. Another acceptable method of attaching composite building panels 20 is, for example welding. For example, the frame member 40 of one composite building panel 20 is welded to the frame member 40 of another composite building panel 20. Various composite panel systems 70 including various combinations of variously configured composite building panels 20 and other structures are within the scope of the present invention.

When composite panel systems 70 are constructed, where necessary, the edges 26,28,30,32 (FIGS. 1–6) of the composite building panels 20 (FIGS. 1–6) are caulked in a conventional manner, as would be understood by those reasonably skilled in the art. Thus, in accordance with some preferred embodiments of the present invention, a small space would be defined between the panels 120,220 in FIG. 10 to facilitate caulking. In accordance with preferred embodiments of the present invention, once a composite panel system 70 is constructed, the cavities 50 (FIG. 4) and passages 52 (FIG. 5) function to receive conventional plumbing (not shown) and electrical wiring (not shown). As discussed below, in accordance with the preferred embodiments of the present invention, the frame members 40 are frame metal studs; therefore, in accordance with the preferred embodiments, metal clad wiring is used within composite panel systems 70. The cavities 50 also function to receive conventional insulation. The fronts 44,56 (FIGS. 4 and 6) of the frame members 40 function to allow for the attachment thereto of wallboard (not shown); whereby the cavities 50 are covered.

Figure 11:
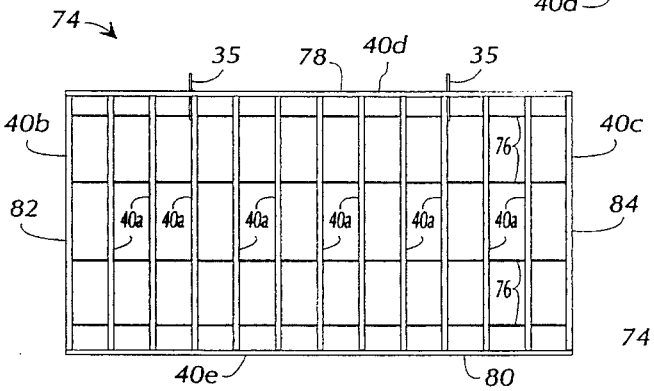
FIG. 11 is a rear view of a frame assembly from which a composite building panel identical to the composite building panel of FIG. 1 is fabricated, in accordance with the first preferred embodiment of the present invention.

Referring to FIG. 11, which is a rear view of a frame assembly 74, composite building panels 20 (FIGS. 1–6) are fabricated by first assembling frame members 40 into a frame assembly 74. The frame assembly 74 includes a top edge 78, a bottom edge 80, a first side edge 82, and a second side edge 84 that correspond, respectively, to the edges 26,28,30,32 of the composite building panel 20 (see FIG. 2). Also, the frame members 40 in FIG. 11 correspond exactly to the frame members of composite building panel 20. An acceptable method of attaching the frame members 40 to one another is, for example, welding. In accordance with the first preferred embodiment, reinforcing rods 76 are attached to the fronts 42 (FIG. 4) of the frame members 40, for example, by welding. Reinforcing wiring is then attached to the reinforcing rods 76; however, wiring is not shown in the figures herewith in an effort to clarify the views. Independently, lifting loops 35 are attached to frame members 40 toward the top edge 78. A frame assembly (not shown) from which a composite building panel 20' would be fabricated would, of course, be shaped to define a window opening 60 (FIGS. 7 and 8) and door opening 62 (FIGS. 7 and 8). Similarly, the frame assemblies (not shown) for variously shaped composite building panels (not shown) would be shaped accordingly, as should be understood by those reasonably skilled in the art upon understanding this disclosure.

Figure 12:
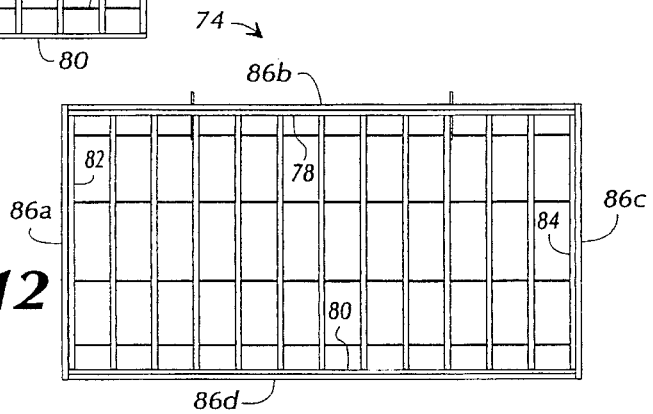
FIG. 12 is a rear view of the frame assembly of FIG. 11, with form members attached thereto, in accordance with the first preferred embodiment of the present invention.

Referring to FIG. 12, which is a rear view of the frame assembly 74 of FIG. 11, once the frame assembly 74 is fabricated, form members 86 are attached to it. Form members 86*a,b,c,d* are attached, respectively, to the edges 78,80, 82,84 of the frame assembly 74. As discussed below, uncured concrete is poured into the appropriate areas bounded by form members 86 to form the concrete slab portion 22. Thus, when fabricating variously shaped composite building panels (e.g., composite building panel 20'), form members 86 are placed so as to bound the area within which uncured concrete (not shown) is to be poured to form a concrete slab portion 22 (FIGS. 1–6), as should be understood by those reasonably skilled in the art upon understanding this disclosure.

Figure 13:
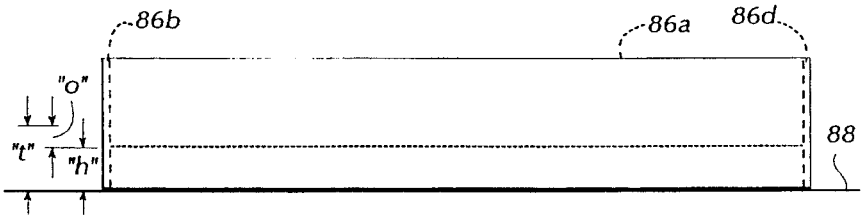
FIG. 13 is a side view of the frame assembly of FIG. 12 engaging a pouring pad, in accordance with the first preferred embodiment of the present invention.

FIG. 13 is a side view toward the first edge 82 of the frame assembly 74 of FIG. 12; thus, only form 86*a* is seen. In FIG. 13, the form members 86 (see also FIG. 12) are engaging a pouring pad 88. The pouring pad 88 is a conventional, planar, horizontal, pad surface that is used in conjunction with conventional forms in the fabrication of precast concrete structures, as should be understood by those reasonably skilled in the art. The frame assembly 74 and forms 86*b,d* are represented by broken lines in FIG. 13. The forms 86 engage the pouring pad 88 and function to support the frame assembly 74 a uniform height "h" above the pouring pad 88. The fronts 42,52 (FIGS. 4 and 6) of the frame members 40 of the frame assembly 74 are oriented toward the pouring pad 88. While the frame assembly 74 is oriented as shown in FIG. 13, uncured concrete (not shown) is poured between the frame members 40 (FIG. 11) of the frame assembly 74 to a thickness "t" that defines an overlap "o" between the uncured concrete and the frame members 40. The thickness "t" and overlap "o" indicated on FIG. 13 correspond directly to the thickness "t" and overlaps "$o_{1,2}$" indicated on FIGS. 4 and 6. The uncured concrete is vibrated to cause it to settle, and allowed to cure, whereby it turns into the concrete slab portion 22 (FIGS. 1–6), and whereby the composite building panel 20 (FIGS. 1–6) is formed. In accordance with the preferred embodiments of the present invention, conventional measures are taken to texture the front surface 34 (FIG. 1) of the concrete slab portion 22, as should be understood by those reasonably skilled in the art. The form members 86 are removed from the newly formed composite building panel 20 which is lifted by the lifting loops 35 (FIGS. 1, 2, 11 and 12) and is ready to function, for example, as part of a composite panel system 70 (FIGS. 9 and 10).

Referring back to FIGS. 1–6, in accordance with the preferred embodiments of the present invention, composite building panels 20 are acceptably constructed, for example, from conventional materials. For example, acceptable frame members 40*a,b,c* are commercially available, conventional, frame metal studs. Likewise, acceptable frame members 40*d,e* are, for example, commercially available, conventional, frame metal tracks that are conventionally used with frame metal studs. The concrete slab portion 22 is acceptably formed, for example, from conventional concrete. Also, conventional reinforcing rods 76 (FIGS. 11 and 12) and reinforcing wire (not shown) are used. The size and configuration of the frame members 40, reinforcing rods 76, and reinforcement wiring, as well as the type and amount of concrete used to fabricate a composite building panel 20, are very dependent upon the intended usage of the fabricated composite building panel 20, as should be understood by those reasonably skilled in the art. For example, a composite building panel 20 used as a wall in a single level house would not be required to have the same frame characteristics as a composite building panel 20 used on the first level of a two story house, or a composite building panel 20 used as a basement wall against which dirt is back-filled. For example, however, in accordance with one preferred embodiment of the present invention, acceptable frame metal studs have a width "w" (FIG. 4) of six inches. Also, in accordance with that embodiment, the concrete slab portion 22 is acceptably fabricated, for example, from 5000 P.S.I. concrete with #7 stone that is poured to a thickness "t" (FIGS. 4, 6 and 13) of approximately three inches. Also, in accordance with that embodiment, acceptable form members 86 (FIGS. 12 and 13) are, for example, wooden boards that are sized and oriented such that there is an overlap "o" (FIGS. 4, 6 and 13) between the concrete slab portion 22 and frame members 40 of approximately one inch.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. A method of fabricating building panels from concrete and elongated frame members using a pouring pad, said method comprising the steps of:

suspending a plurality of elongated frame members above the pouring pad, wherein each elongated frame member of the plurality of elongated frame members defines a length and a width, wherein each elongated frame member of the plurality of elongated frame members defines a first elongated side substantially extending the length of the elongated frame member, and a second elongated side connected to and opposite from said first elongated side, and substantially extending the length of the elongated frame member, wherein the length is greater than the width, and wherein the step of suspending includes, at least, the step of orienting the elongated frame members of the plurality of elongated frame members such that the length of the elongated frame members is generally parallel to the pouring pad, and the first elongated sides are oriented toward the pouring pad;

depositing uncured concrete onto the pouring pad to a depth such that substantially all of the entire first elongated side of each elongated frame member of the plurality of elongated frame members is embedded in the concrete, and the second elongated side of each elongated frame member of the plurality of elongated frame members is distant from the concrete; and allowing the concrete to cure.

2. The method of claim 1, wherein the first elongated side and the second elongated side of each elongated frame member of the plurality of elongated frame members define the width therebetween, wherein the step of suspending further includes, at least, the step of orienting elongated frame members of the plurality of elongated frame members such that the width is perpendicular to the pouring pad, and wherein the step of depositing uncured concrete includes, at least, the step of depositing a specific amount of uncured concrete such that the uncured concrete defines a surface that is disposed between the first side and the second side of elongated frame members of the plurality of elongated frame members along the entire length of the elongated frame members of the plurality of frame members.

3. The method of claim 1, wherein the step of suspending proceeds any depositing of uncured concrete on the pouring pad.

4. The method of claim 1, wherein the step of suspending includes, at least, interconnecting the plurality of elongated frame members to define a frame assembly, wherein the frame assembly defines a frame periphery, rigidly connecting form members to the frame periphery of the frame assembly, and arranging the form members so that the frame members contact the pouring pad and hold the frame assembly above the pouring pad, and wherein the step of depositing uncured concrete includes, at least, depositing uncured concrete between the form members.

5. A method of fabricating building panels from concrete and elongated frame members using a pouring pad, the method comprising the steps of:

suspending a plurality of elongated frame members above a pouring pad, wherein each elongated frame member of the plurality of elongated frame members defines a length and a width, wherein the length is greater than the width, and wherein the step of suspending includes a step of orienting the elongated frame members of the plurality of elongated frame members such that the length of the elongated frame members is generally parallel to the pouring pad;

depositing uncured concrete onto the pouring pad to a depth such that elongated frame members of the plurality of elongated frame members are partially embedded in the concrete; and allowing the concrete to cure into a concrete slab.

6. The method of claim 5, wherein each elongated frame member of the plurality of elongated frame members includes, a first side extending the length of the elongated frame member, and a second side opposite from the first side and extending the length of the frame member, wherein the step of suspending further includes a step of orienting the first side of elongated frame members of the plurality of elongated frame members toward the pouring pad, and wherein the step of depositing includes a step of depositing a sufficient amount of uncured concrete such that the uncured concrete defines a surface that is disposed between the first side and the second side of elongated frame members of the plurality of elongated frame members.

7. The method of claim 5, wherein the step of suspending includes steps of interconnecting the plurality of elongated frame members to define a frame assembly that includes peripheral edges, connecting form members to the peripheral edges of the frame assembly such that the form members extend around the frame assembly, and abutting the form members to the pouring pad such that the frame assembly is suspended above the pouring pad.

8. The method of claim 7, wherein the step of depositing is carried out such that the uncured concrete abuts the form members.

9. The method of claim 7, wherein the method further comprises a step of removing at least a portion of the form members from the frame assembly subsequent to the formation of the concrete slab.

10. The method of claim 7, wherein each elongated frame member of the plurality of elongated frame members includes, a first side extending the length of the elongated frame member, and a second side opposite from the first side and extending the length of the frame member, wherein the step of suspending further includes a step of orienting the first side of elongated frame members of the plurality of elongated frame members toward the pouring pad, and wherein the step of depositing includes a step of depositing a sufficient amount of uncured concrete such that the uncured concrete defines a surface that is disposed between the first side and the second side of elongated frame members of the plurality of elongated frame members.

11. The method of claim 5, wherein the cured concrete slab defines a slab front surface a slab rear surface, and an opening extending through the concrete slab portion, wherein the concrete slab portion at least partially bounds the opening and the opening is accessible at the slab front surface and slab rear surface, and wherein elongated frame members of the plurality of elongated frame members at least partially bound and at least partially define the opening.

12. The method of claim 11, wherein each elongated frame member of the plurality of elongated frame members includes, a first side extending the length of the elongated frame member, and a second side opposite from the first side and extending the length of the frame member, wherein the step of suspending further includes a step of orienting the first side of elongated frame members of the plurality of elongated frame members toward the pouring pad, and wherein the step of depositing includes a step of depositing a sufficient amount of uncured concrete such that the uncured concrete defines a surface that is disposed between the first side and the second side of elongated frame members of the plurality of elongated frame members.

13. The building panel of claim 11, wherein the concrete slab portion includes a first edge, and a second edge connected to and extending from the first edge, wherein the first edge and the second edge cooperate to at least partially bound and at least partially define the opening, and wherein the plurality of elongated frame members includes a first frame member coextensive with the first edge of the concrete slab portion, a second frame member coextensive with the second edge of the concrete slab portion, wherein the second frame member is connected to and extends from the first frame member, and wherein the first frame member and the second frame member at least partially bound and at least partially define the opening.

14. The building panel of claim 13, wherein the opening is a window opening.

15. The building panel of claim 13, wherein the opening is a door opening.

16. The building panel of claim 13, wherein the concrete slab portion further includes a third edge connected to and extending from the second edge, a fourth edge connected to and extending between the third edge and the first edge, wherein the first edge, the second edge, the third edge, and the fourth edge cooperate to at least partially bound and at least partially define the opening, wherein the plurality of elongated frame members further includes a third frame member coextensive with the third edge of the concrete slab portion and connected to and extending from the second frame member, and a fourth frame member coextensive with the fourth edge of the concrete slab portion, wherein the fourth frame member is connected to and extends between the third frame member and the first frame member, and wherein the first frame member, the second frame member, the third frame member, and the fourth frame member cooperate to at least partially bound and at least partially define the opening.

17. A method of fabricating building panels from concrete and frame members, the method comprising the steps of suspending the frame members above a pouring pad, depositing uncured concrete onto the pouring pad to a depth such that part of the frame members are embedded in the concrete, and allowing the concrete to cure.

* * * * *